United States Patent [19]

Bolldorf

[11] 3,991,691

[45] Nov. 16, 1976

[54] MECHANISM FOR ADJUSTABLY POSITIONING AN EMBROIDERING FRAME

[75] Inventor: Kurt Bolldorf, Kaiserslautern, Germany

[73] Assignee: Pfaff Industriemaschinen GmbH, Kaiserslautern, Germany

[22] Filed: Nov. 5, 1975

[21] Appl. No.: 629,149

[30] Foreign Application Priority Data

Nov. 6, 1974 Germany ..... 2452631

[52] U.S. Cl. ..... 112/86; 112/90

[51] Int. Cl.[2] ..... D05C 5/00

[58] Field of Search ..... 112/90, 91, 86, 102, 112/103, 84

[56] References Cited

UNITED STATES PATENTS

| | | | |
|---|---|---|---|
| 3,183,866 | 5/1965 | Walbert et al. | 112/90 |
| 3,468,268 | 9/1969 | Rolauffs | 112/86 |
| 3,802,360 | 4/1974 | Rolauffs et al. | 112/86 |

*Primary Examiner*—Alfred R. Guest
*Attorney, Agent, or Firm*—Toren, McGeady and Stanger

[57] ABSTRACT

Stepping mechanisms are used to move an embroidering frame in both the vertical and horizontal directions on a machine frame. Each stepping mechanism includes a hydraulic cylinder-piston rod assembly, a multi-way valve for directing the flow of hydraulic fluid to the assembly, and an electric stepping motor connected to the valve for regulating the flow to the assembly. To effect movement a signal is transmitted to the stepping motor which positions the valve to operate the hydraulic cylinder-piston rod assembly. The piston rod is in direct contact with the frame and its movement provides the desired movement of the embroidering frame. The piston rod is connected to the stepping motor for closing the valve when the desired position of the embroidering frame has been reached.

11 Claims, 5 Drawing Figures

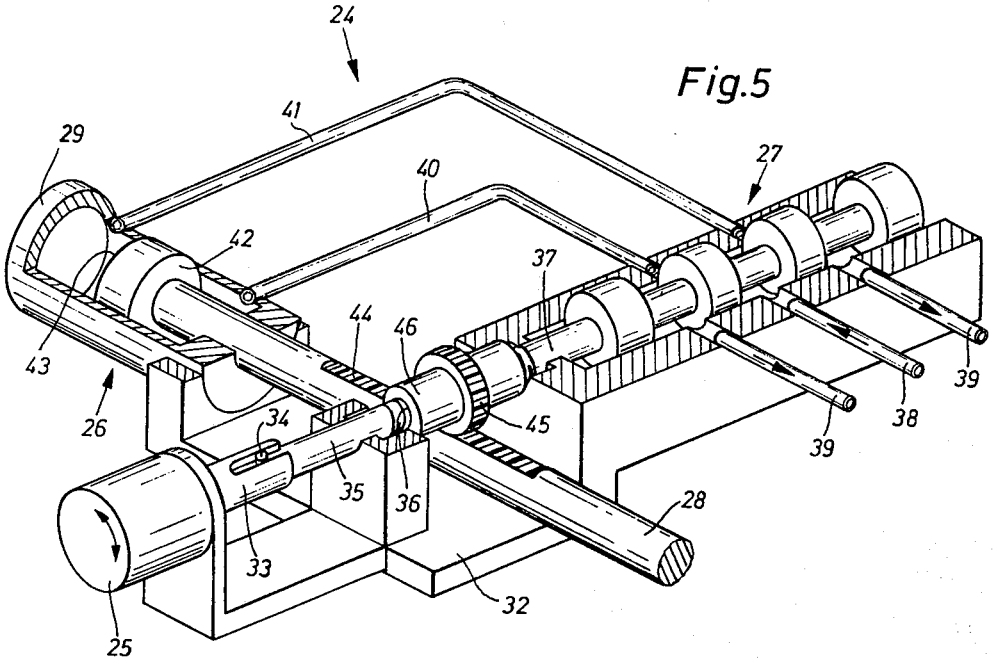
Fig.5
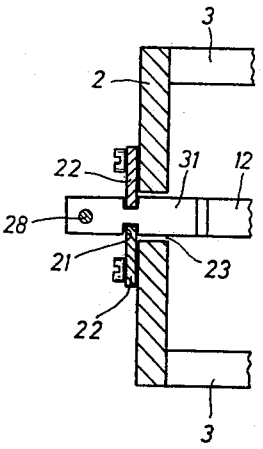
Fig.4
Fig.3
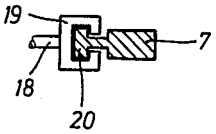

MECHANISM FOR ADJUSTABLY POSITIONING AN EMBROIDERING FRAME

SUMMARY OF THE INVENTION

The invention concerns an embroidering machine in which an embroidering frame is supported from a machine frame and is adjustable in both the horizontal and vertical directions and, more particularly, it concerns a mechanism including hydraulic cylinder-piston rod assemblies which effect the desired adjustability and secure or support the embroidery frame in the desired position.

To move the embroidering frame in an embroidering machine, which frame weighs about 700 to 1000 kg, it has been known to use mechanical drives which employ a shaft extending over the entire length of the embroidering frame and the shaft is secured to the frame by means of cam plates and steel belts. To keep the forces required to move the embroidering frame as low as possible, the frame is maintained in a labile equilibrium position by a special weight balance, so that only the forces required to overcome friction and inertia have to be expended in moving the frame.

Since mechanical drives permit only a relatively low adjusting speed of the embroidering frame, hydraulic drives have been used to replace the mechanical drives. A hydraulic motor with a pinion arranged on the extension of its axis operatively is associated with the embroidering machine to transmit the requisite driving movements of the hydraulic motor to a rack and carriage connected to the embroidering frame. Both axial piston motors and double-acting hydraulic cylinders can be used as the hydraulic motor, however, it has not been possible to eliminate the devices for maintaining the embroidering frame in the labile equilibrium position.

It is also known to fix the embroidering frame to threaded spindles and to switch the valves controlling driving hydraulic motors into a controlled circuit of a so-called followup unit, which produces a manipulated variable adjustment of the embroidering frame corresponding to a nominal actual value-comparison, see Austrian Patent No. 268,846. Double-acting hydraulic cylinders are used as the hydraulic motors and can be controlled over electro-hydraulic regulating valves.

Such an arrangement works in the same manner as indicated above and, accordingly, has limited precision. Its setting time is increased by transient processes. Furthermore, it is sensitive to disturbing variables. The interposition of a mechanical screw with a spindle gear causes friction losses and reduced adjustment accuracy, since there is play in such parts.

The rapid movement of these embroidering frames, considering the precision required in the adjusting movement, involves a considerable engineering effort and tends to increase susceptibility to problems in the overall embroidering frame drive.

To reduce the susceptibility to difficulties, means for balancing the weight have always been provided in hydraulic drives with two separate synchronized drives in the range of the front ends of the embroidering frame. These means consist generally of torsion springs. Accordingly, a displacement of the spring bearing brackets corresponding to the slope of the spring characteristic must be balanced by the adjusting movements of the embroidering frame and involves a very complicated construction.

Therefore, it is a primary object of the present invention to provide a drive for adjusting the position of an embroidery frame in an embroidering machine, particularly in the vertical direction, which drive insures the required adjustment, accuracy and speed in a simpler manner than has been achieved in the past and incorporates in the drive the function of the necessary weight balance.

In accordance with the present invention, the embroidering frame is adjustably positioned in the embroidering machine by a stepping mechanism which includes hydraulic motors that are directly connected to the embroidering frame.

To provide the requisite vertical adjusting movements for an embroidering frame, two synchronously controlled electro-hydraulic stepping mechanisms with initial linear movement are used and a similar single electro-hydraulic stepping mechanism is used for affording horizontal adjustment of the frame. In each of these mechanisms, a hydraulic cylinder-piston rod assembly has the piston rod acting directly on the embroidering frame and supporting or holding it in the adjusted position, parallel to the principal directions of motion of the embroidering frame.

In a preferred embodiment of the invention, the electro-hydraulic stepping mechanism includes a double-acting hydraulic cylinder-piston rod assembly which provides the desired displacing action and the movement of the piston rod is regulated by a two/five valve controlled by an electric stepping motor. The piston rod and the electric motor are interconnected so that the valve can be moved into its starting position after the adjusting movement of the frame has been accomplished.

The electric stepping motor is connected to the two/five valve by a threaded spindle and a rack and pinion arrangement is provided between the piston rod and the threaded spindle for effecting the regulation of the valve as the piston rod moves the embroidering frame into a selected position.

In the selected position the piston rod holds or supports the frame.

Due to the arrangement embodying the present invention, this is the first time it has been possible to hold the embroidering frame in position hydraulically and set so-to-speak digitally. This arrangement affords the possibility of accurately supplying the hydraulic fluid needed for adjusting the position of the embroidering frame in a very accurate and rapid manner. Further, the movements of the piston rods act directly on the embroidering frame. The hydraulic cylinder-piston rod assemblies in accordance with the invention are capable of fully absorbing the total weight of the embroidering frame and of effecting the adjusting movements under full load with the required accuracy. The control for the adjusting movement of the embroidering frame is particularly simple and ensures a sufficiently long maintenance of the position of the embroidering frame between individual adjusting movements.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

In the drawing:

FIG. 3 is a partial sectional view taken along the line III—III of FIG. 1;

FIG. 4 is a partial sectional view taken along the line IV—IV in FIG. 1; and

FIG. 5 is a perspective view on an enlarged scale of a portion of the apparatus shown in FIG. 1.

DETAILED DESCRIPTION OF THE INVENTION

Figures 1, 2:
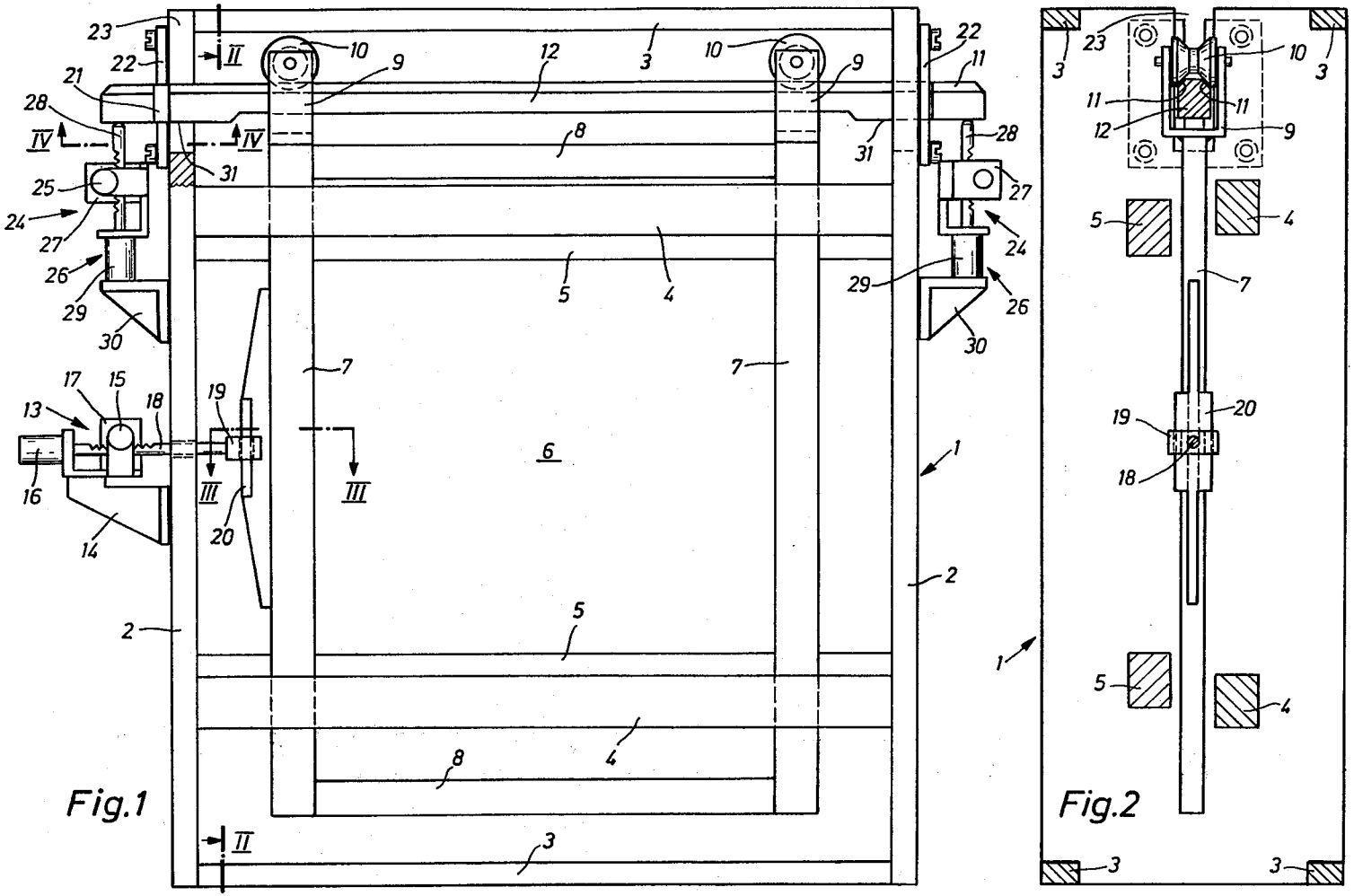
FIG. 1 is a schematic front view of an embroidering machine embodying the present invention.
FIG. 2 is a sectional view taken along the line II—II of FIG. 1.

In FIG. 1 an embroidering machine frame 1 is shown consisting of two vertically extending side members 2 and two horizontally extending cross members 3 extending between the side members. Needle supports 4 are located within the frame between and in generally parallel relation with the cross members 3. The needles, not shown, on the needle supports cooperate with shuttles, not shown, positioned on shuttle supports 5 which extend in parallel relation with the needle supports. The drive of the needles and the shuttles, not shown, is effected in a known manner.

Within the frame 1 is an embroidering frame 6 on which the material to be embroidered is supported. The embroidering frame consists of two vertically extending side components 7 connected together adjacent their opposite ends by cross components 8. As can be seen best in FIG. 2, a yoke or fork-head 9 is attached to the upper end of each side component 7 and carries a profiled roller 10. The profiled roller rides on guide faces 11 of a lifting support 12 so that the embroidering frame is freely suspended during its horizontal adjusting movements guided on the lifting support 12 which extends horizontally across the top of the embroidering frame.

The horizontal adjusting movement of the embroidering frame 6 is provided by an electro-hydraulic stepping mechanism consisting of a cylinder unit 12 mounted on a bracket 14 secured to one of the side members 2 of the frame 1. The cylinder unit 13 which is more completely described below, consists of an electric stepping motor 15, a double-acting hydraulic cylinder 16 and a multi-way valve 17. The hydraulic cylinder 16 includes a horizontally extending piston rod 18 secured at its outer or free end to a guidepiece 19, see FIG. 3, which embraces a radius link 20 on the side component 7 of the embroidering frame 6. The radius link on the side component 7 is vertically displaceable relative to the guidepiece 19 and permits the piston rod to fix the embroidering frame in the horizontal direction while permitting relative vertical displacement between the guidepiece 19 and the radius link 20.

At each of its opposite ends, the lifting support 12 extends through slots 23 in the side members 2 and two guide grooves 21 are formed on the opposite sides of the lifting support just outwardly of the slot 23. Guidepieces 22 are fixed to the side member 2 and extend into the guide grooves 21 and afford a guiding action for the lifting support as it is moved in the vertical direction. The vertical adjusting movement of the embroidering frame 6 is provided by displacing the lifting support 12 within the slots 23 in the side members and the movement is effected over a pair of electro-hydraulic stepping mechanisms each acting on an opposite end of the lifting support. Each of these electro-hydraulic stepping mechanisms consists of a cylinder unit 24 which includes an electric stepping motor 25, a double-acting hydraulic cylinder 26 and a multi-way valve 27. Each of the hydraulic cylinders 26 has a vertically extending piston rod 28 which effects the vertical adjusting movements of the embroidering frame with the piston rod being disposed in direct supporting contact with an end of the lifting support 12. Each hydraulic cylinder 26 has a cylinder housing 29 mounted upon a bracket 30 secured to one of the side members 2. To afford a rest position of the embroidering frame 6 on the frame 1 in which the cylinder units 24 are relieved of the embroidering frame load, a bearing surface 31 is provided on the underside of the lifting support 12 at each of its ends which can rest on its associated side member 2 within the slot 23 when the piston rod 28 is retracted downwardly below the lower end of the slot 23.

The cylinder units 13 and 24 are identical in their constructional design, the only difference is that the movement of the piston rod in cylinder unit 13 is disposed horizontally at an angle of 90° to the movement of the piston rod in the cylinder unit 24. Accordingly, in the following only the cylinder unit 24 is described.

As can be seen on an enlarged scale in FIG. 5, the electric stepping motor 25, the hydraulic cylinder 26 and the multi-way valve 27, also called the two/five valve, of each cylinder unit is arranged within a common housing 32. Electric stepping motor 25 is arranged to receive control pulses from a multi-channel perforated tape, a Jacquard tape or a magnetic tape and the motor has an output shaft 33 which is non-rotatably connected over a coupling 34 with a threaded spindle 35 so that the spindle is axially displaceable relative to the coupling. The threaded spindle 35 is mounted in the housing 32 and extends through a threaded nut 36 also mounted within the housing and fixed against displacement in the axial direction of the spindle.

The threaded spindle 35, which is axially displaceable within certain limits within the housing, is connected at its free end, that is the end spaced from the coupling 34 to a piston rod 37 of the multi-way valve 27 which operates as a slide valve. The piston rod or spool 37 has a number of spaced lands on its surface and is axially displaceable within the valve for dividing its interior into a number of chambers. The multi-way valve 27 has an inlet connection 38 connected to a pump, not shown, for supplying pressurized hydraulic fluid into the valve. Further, spaced from the inlet connection 38 are two tank connections 39 for returning hydraulic fluid to its source. Additionally, two working outlets 40, 41 are provided from the valve for supplying hydraulic fluid to the hydraulic cylinder 26. The working outlet 40 supplies hydraulic fluid into the chamber within the cylinder so that it acts on the piston surface 42 and the other outlet 41 is connected to the cylinder so that its supplies hydraulic fluid into the other chamber on the opposite side of the piston so that it acts on piston surface 43. On the portion of the piston rod 28 extending outwardly from the cylinder 26 there is a toothed rack 44 as shown in FIG. 5 which meshes with a gear wheel or pinion 45. The pinion 45 is fixed on a hollow shaft 46 supported within the housing 32 and disposed coaxially with the threaded spindle 35. The hollow shaft or sleeve 46 is integral with the threaded nut 36 so that, when the piston rod 28 of the hydraulic cylinder 26 is displaced, the action of the rack 44 on the pinion 45 causes a rotary movement of the sleeve 46-threaded nut 36 effecting an axial displacement of the threaded spindle 35. The metric module and the number of teeth in the gear wheel or pinion 45 are selected so that the stroke of the piston rod 28 in the hydraulic cylinder 26, which is derived from a certain displacement of the piston rod or spool 37 in the multi-way valve 27, effects an angle of rotation of the pinion 45 which rotates the threaded nut 36 and the threaded spindle 35 to the same extent but in the opposite direction so that the piston rod 37 of the valve is moved opposite to its original movement by the stepping motor.

Though the stepping motors 25 of the two cylinder units 24 ensure an extremely accurate displacement of the embroidering frame, two monitoring switches can be provided on the lifting support to ensure a constant, accurate horizontal position of the embroidering frame which act on any deviation of the lifting support from the horizontal position on at least one of the stepping motors, thus effecting a correction of the position of the embroidering frame 6.

The adjusting movement of the embroidering frame is carried out as follows:

If it is assumed that the embroidering frame 6 is in the rest position, then the piston rod 37 of the multi-way valve is in its neutral center position in which the lands on the spool or piston rod close the connections or outlets 40,41 to each of the chambers in the hydraulic cylinder 26. The two piston surfaces 42, 43 on the piston end of the piston rod 28 are held in position so that the total weight of the embroidering frame 6 is carried by the two piston rods 28, note FIG. 1. If the embroidering frame is to be moved in the vertical direction in accordance with the pattern being produced, a pulse is imparted to each of the two stepping motors 25 by a multi-channel perforated tape or by a Jacquard tape, not shown. The two stepping motors perform a synchronous rotary movement corresponding to the size and direction of the pulse and impart to each of the threaded spindles 35 a rotary movement over the coupling 34. Since the pinion 45 meshes with the rack 44 on the piston rod 28, and the sleeve or hollow shaft 46 carrying the pinion is integral with the threaded nut, the threaded nut is secured against rotation. Accordingly, due to its rotary movement, the threaded spindle 35 is displaced in its axial direction and the piston rod or spool 37 of the valve connected to it moves in the same direction. If the stepping motor 25 rotates in the clockwise direction, as viewed in FIG. 5, due to the pulse imparted to it, the piston rod is displaced to the right. With such displacement, the outlet 40 of the multi-way valve 27 is connected to the connection 39, which extends to the hydraulic fluid source, while the other outlet 41 is connected to the connection 38 which, in turn, is connected to the source of pressurized hydraulic fluid. Due to this instantaneous connection of the outlets 40,41 with the connections 39,38, respectively, the forces acting on the piston surfaces 42,43 are changed and the piston on the end of piston rod 48 moves to the right, as viewed in FIG. 5, resulting in an upward movement of the embroidering frame corresponding to the extent of displacement of the piston rod.

As the embroidering frame 6 moves upwardly within the machine frame 1, the pinion 45 in meshed engagement with the rack 44 on the piston rod 28 undergoes rotary movement which is transmitted via the sleeve 46 to the threaded nut 36 integral with it. Since the threaded spindle is connected to the coupling 34 of the stepping motor 25, it is secured against rotation and the threaded spindle is moved to the left, as viewed in FIG. 5, by the rotary movement derived from the lifting movement of the piston rod 28. At the termination of the movement of the piston rod, the threaded spindle 35 and with it the spool 37 of the valve again reaches it neutral center position in which the outlets 40,41 are closed by the lands on the spool. With the outlets 40,41 closed, the piston rods support the lifting support 12 and, in turn, the embroidering frame and hold it in its at rest position. As a result, the device which was necessary in the past for balancing the weight of the embroidering frame and which had a highly elaborate construction, can be eliminated.

While a specific embodiment of the invention has been shown and described in detail to illustrate the application of the inventive principles, it will be understood that the invention may be embodied otherwise without departing from such principles.

What is claimed is:

1. A movable support arrangement for use in an embroidering machine including a movably supported embroidering frame, a hydraulic mechanism for moving said embroidering frame in the vertical and horizontal direction, control means connected to said hydraulic mechanism for controlling the movement of said embroidering frame effected by said hydraulic mechanism in accordance with a signal transmitted to said control means wherein said hydraulic mechanism comprises a stepping means in direct supporting contact with said embroidery frame for moving said embroidery frame into a selected position in accordance with the signal delivered to said control means and for holding said embroidering frame in the selected position.

2. A movable support arrangement, as set forth in claim 1, wherein said stepping means comprises a hydraulic device having a linearly displaceable member disposed in direct supporting contact with said embroidery frame for effecting the desired displacement of said embroidering frame.

3. A movable support arrangement, as set forth in claim 2, wherein said embroidering frame includes a horizontally extending support, and a pair of said hydraulic devices each having a linearly displaceable member disposed in direct supporting contact with said support at horizontally spaced positions for vertically displacing said embroidering frame.

4. A movable support arrangement, as set forth in claim 2, wherein said embroidering frame includes at least one vertically extending side member, and said hydraulic device has its linearly displaceable member disposed in direct contact with said side member for horizontally displacing said embroidering frame.

5. A movable support arrangement, as set forth in claim 2, wherein said hydraulic device comprises a double-acting hydraulic cylinder including a piston within said cylinder with said piston dividing said cylinder into two variable volume chambers each on an opposite side of said piston, said cylinder having an opening therein to each of said chambers, said linearly displaceable member comprises a piston rod connected to said piston and extending outwardly from said hydraulic cylinder, said control means comprises a multi-way valve connected to the openings into said chambers in said cylinder for flowing hydraulic fluid into and from said chambers and for maintaining hydraulic fluid within said chambers in said hydraulic cylinder, and an electric stepping motor connected to said multi-way valve for selectively positioning said valve for directing the flow of hydraulic fluid into one of the chambers in said hydraulic cylinder for linearly displacing said piston rod, and said piston rod disposed in engagement with said stepping motor.

6. A movable support arrangement, as set forth in claim 5, wherein said multi-way valve includes a valve body, an axially displaceable spool located within said valve body for varying the direction of flow of the hydraulic fluid through said valve body to said hydraulic cylinder, said stepping motor comprising a threaded spindle connected to said spool for positioning said spool within said housings, a pinion mounted on said threaded spindle, and said piston rod having a rack formed on its surface with said rack disposed in meshed engagement with said pinion.

7. A movable support arrangement, as set forth in claim 6, wherein a housing is provided for containing said hydraulic device, said multi-way valve and said stepping motor, said pinion being coaxial with said threaded spindle and secured within said housing against displacement in the axial direction of said spindle, a sleeve coaxial with said threaded spindle with said pinion formed on the exterior surface thereof, said sleeve being threaded on its interior surface and said threaded spindle disposed in threaded engagement with the threaded interior surface of said sleeve so that rotation of said pinion and sleeve by said piston rod with said sleeve held against axial displacement, effects axial displacement of said threaded spindle.

8. A movable support arrangement, as set forth in claim 7, wherein said multi-way valve is a two/five valve.

9. A movable support arrangement, as set forth in claim 5, wherein means are arranged for maintaining the adjustment of said embroidering frame by said hydraulic device.

10. A movable support arrangement, as set forth in claim 7, wherein a coupling is attached to said stepping motor with said threaded spindle being axially displaceably secured to said stepping motor by said coupling so that said coupling can prevent rotation of said threaded spindle when said stepping motor is inoperative so that said threaded spindle can move axially relative to said coupling.

11. A movable support arrangement, as set forth in claim 5, including a machine frame, said machine frame comprising a pair of laterally spaced vertically extending side members and a pair of horizontally extending end members extending between said side members with one said end member forming the top of said frame and the other said end member forming the bottom of said frame, said side members being slotted in the vertical direction, said embroidering frame including a supporting member, said supporting member fitting into and being vertically displaceable within said slots in said side members, said support member forming a horizontally extending guide rail, and means on said embroidering frame in moving contact with said guide rail for displacing said embroidering frame in the direction of said supporting member.

* * * * *